US005600927A

United States Patent [19]

Kennon

[11] Patent Number: 5,600,927

[45] Date of Patent: Feb. 11, 1997

[54] STRAPPED REBAR END PROTECTOR

[76] Inventor: Add T. Kennon, 6 Sandy Beach, Vallejo, Calif. 94590

[21] Appl. No.: 431,964

[22] Filed: Jun. 14, 1995

[51] Int. Cl.[6] ..... E04C 5/16

[52] U.S. Cl. ..... 52/301; 52/741.1

[58] Field of Search ..... 24/706.3; 52/301, 52/DIG. 12, 721.2, 740.1, 741.1; 138/96 R; 222/543

[56] References Cited

U.S. PATENT DOCUMENTS

| | | | |
|---|---|---|---|
| 1,175,173 | 8/1915 | Ojczyk | 24/706.3 X |
| 1,360,952 | 11/1920 | Homan | 24/706.3 X |
| 1,372,648 | 3/1921 | Crowell | 24/706.3 X |
| 4,090,647 | 5/1978 | Dunning | 222/543 |
| 4,833,850 | 5/1989 | Lunn | 52/301 |
| 5,154,327 | 10/1992 | Long | 222/543 X |
| 5,299,883 | 4/1994 | Arth, Jr. | 52/301 X |
| 5,313,757 | 5/1994 | Schnepf | 52/301 |
| 5,363,618 | 11/1994 | Underwood | 52/301 |
| 5,381,636 | 1/1995 | Kassardjian et al. | 138/96 R X |
| 5,469,679 | 11/1995 | Burkard et al. | 52/DIG. 12 X |

*Primary Examiner*—Michael Safavi
*Attorney, Agent, or Firm*—Douglas E. White; Acronational Law Firm

[57] ABSTRACT

Strapped rebar end protector apparatus combines prior art end protectors with an elastic strap having a rebar-receiving aperture in one end and fastener means on the other. The preferred fastener is a snap-in type which enters relatively easily a snap-receiving aperture drilled in the end protector wall, but which is hard to pull out again. The device is installed by first threading the rebar end through the open rebar aperture of the strap and then threading the rebar end into the interior channel of the protector, where vertical support ribs in the protector interior grip the rebar. Provided that the elastic strap has been extended down the rebar a distance sufficient to place it under tension (a tab portion extends beyond the rebar aperture for grasping and pulling), the rebar end protector will remain in place against a more significant force than previously. Furthermore, the stretched strap tends to re-seat the end protector after each knock or brash against it, thus preventing a series of small forces from loosening the end protector incrementally.

8 Claims, 2 Drawing Sheets

FIG. 1
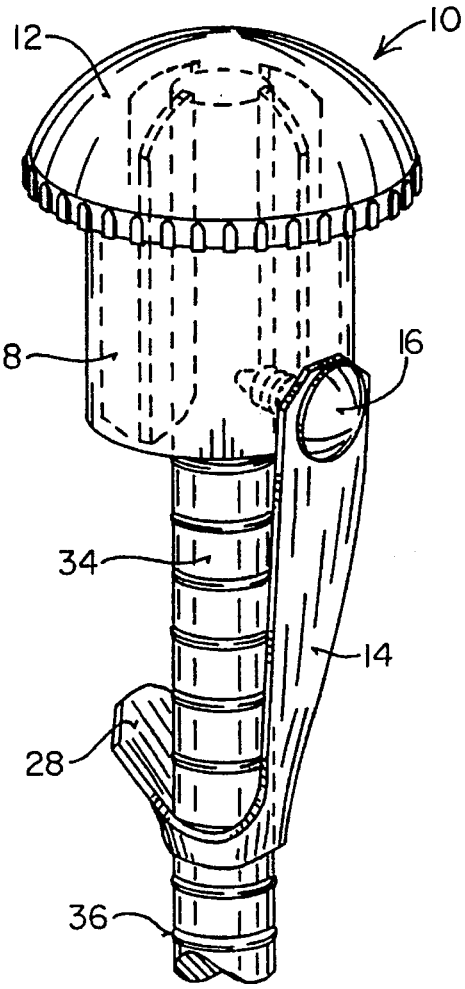
FIG. 2
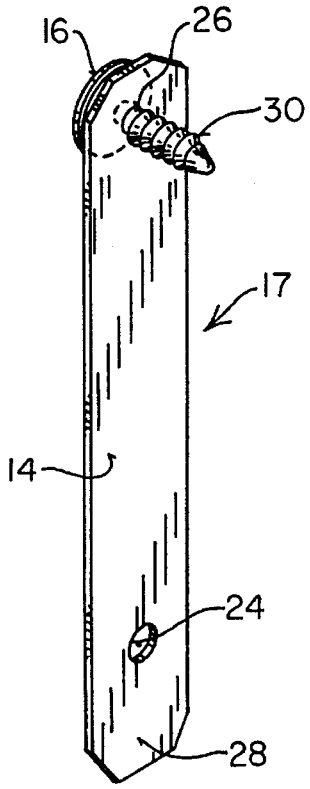
FIG. 3
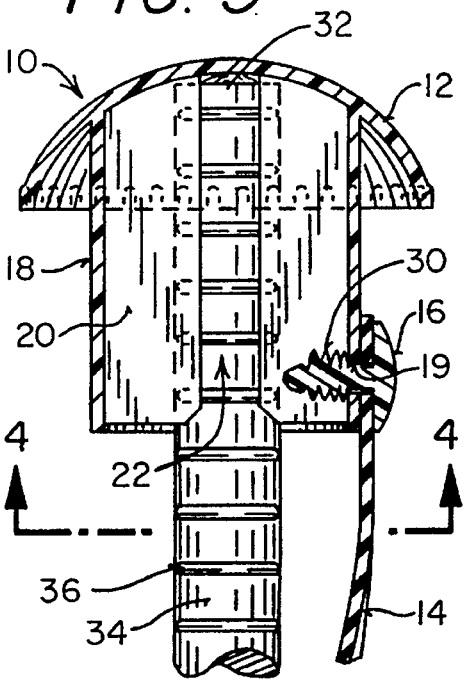
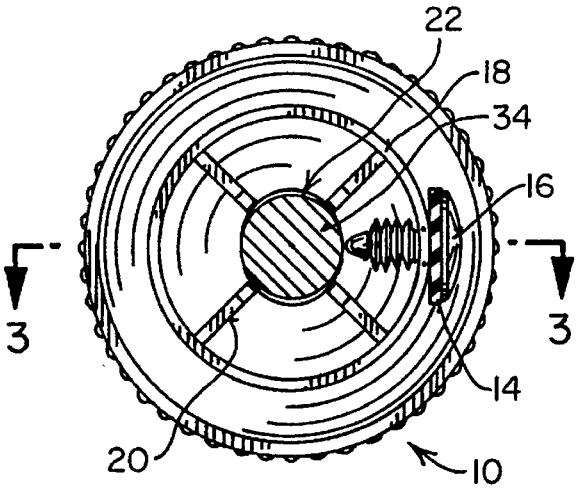
FIG. 4

FIG. 5
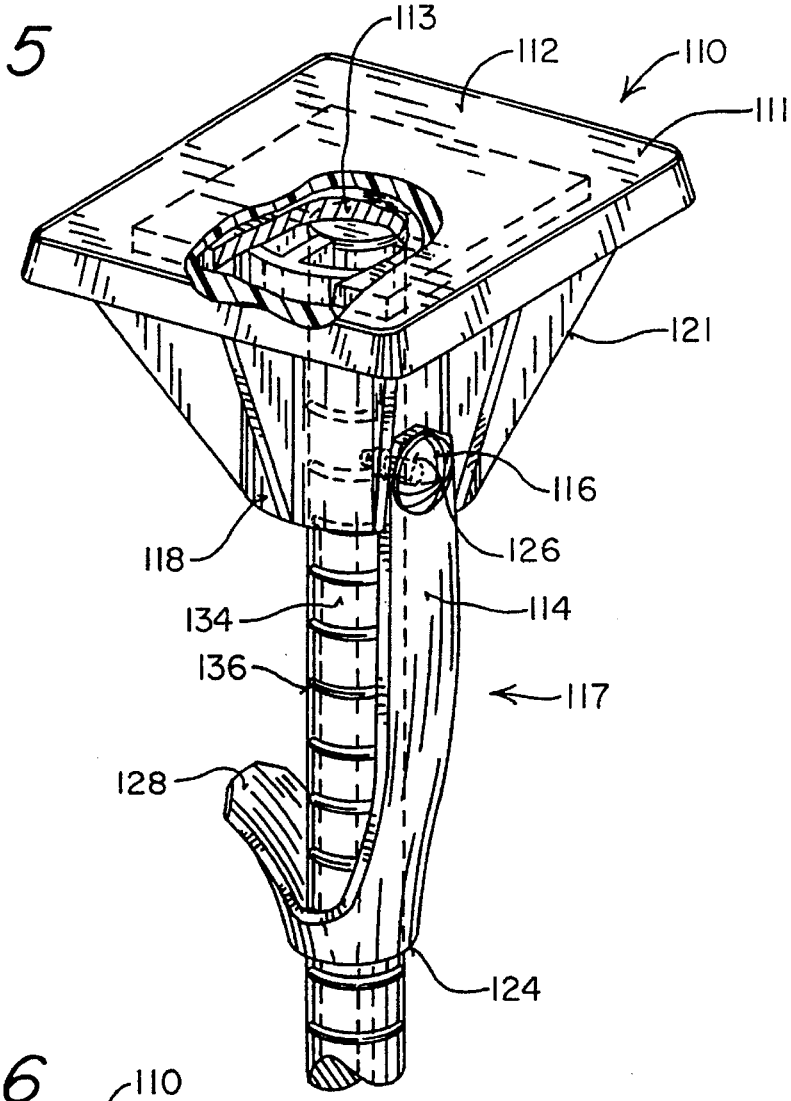
FIG. 6
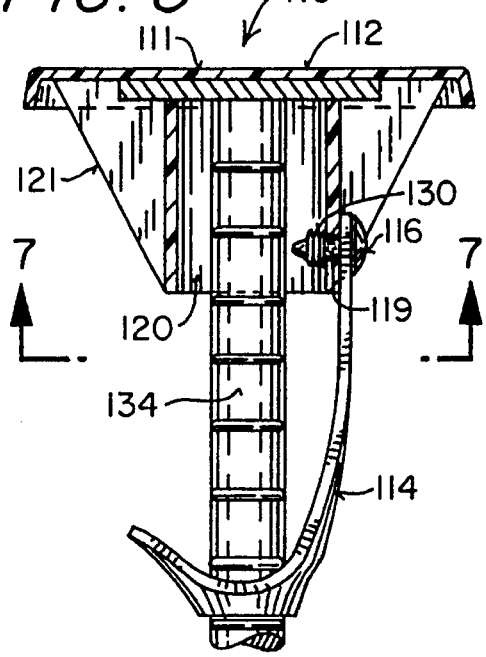
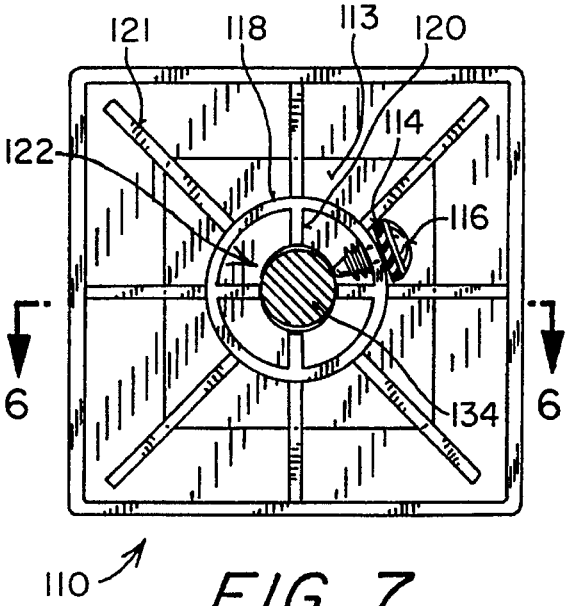
FIG. 7

STRAPPED REBAR END PROTECTOR

FIELD OF THE INVENTION

This invention relates to construction safety equipment, more particularly to apparatus for covering exposed ends of metal concrete-reinforcing bars.

BACKGROUND OF THE INVENTION

"Rebar" (concrete-reinforcing bar) end protectors are old. These plastic end protectors are used in construction sites to prevent workers from falling on the rebar ends and getting impaled or otherwise injured. A problem with existing protectors is that knocking or brushing against them easily snaps them off—dangerously re-exposing the rebar end. There are so many ways that rebar en :1 protectors get brushed off, that at any one time on a construction project, a significant number of rebar ends may be exposed and unprotected, even though workers make a conscientious effort promptly to replace dislodged protectors.

SUMMARY OF THE INVENTION

The present invention is a combination of the prior art end protectors with an elastic strap having a rebar-receiving aperture in one end and a fastener on the other. The preferred fastener is the commercially-available snap-in type, which type enters relatively easily a snap-receiving aperture drilled or molded into the end protector wall, but which is hard to pull out again. Other fastener types would include screws, nuts and bolts, rivets or the like.

The device is installed by first threading the rebar end through the open rebar aperture of the strap and then threading the rebar end into the interior channel of the protector, where vertical support ribs formed in the protector interior grip the rebar.

Provided that the elastic strap has been extended down the rebar a distance sufficient to place it under tension, the rebar end protector will remain in place against a more significant force than previously possible. Furthermore, the stretched strap tends to re-seat the end protector after each knock or brush against it, thus preventing a series of small forces from loosening the end protector incrementally.

One embodiment of the invention utilizes and improves upon the conventional "mushroom-shaped" end protector. Another embodiment utilizes the newer "flat-topped" protector.

FEATURES AND ADVANTAGES

An object of this invention is to disclose, in combination with a conventional rebar end protector having a wall, the improvement comprising a strap affixed to the end protector, the strap having a rebar-receiving aperture formed at a first end of the strap.

Another object or feature is that the strap is elastic.

Another feature is that the strap preferably is affixed to the wall of the end protector.

Yet another feature is fastener means for affixing the strap to the end protector.

Still another feature is preferably, the fastener means includes a snap-receiving aperture formed in the wall, and a snap fastener affixed to the strap, the snap fastener engagable within the snap-receiving aperture.

Preferably, a feature of the snap fastener is disk catch means on the snap fastener for holding the snap fastener in the snap-receiving aperture.

Yet another feature is a snap fastener aperture formed at a second end of the strap, the snap fastener engaged within the snap fastener aperture of the strap and within the snap-receiving aperture of the wall.

Another feature or object is to disclose a method of protecting the exposed end of a rod of rebar including providing a protector member having a downwardly depending circumferential wall. The protector member also has a rebar-receiving channel formed within the interior of the wall. The next step is drilling a snap-receiving aperture into the wall. Next, a snap and strap member is provided having an elastic strap with a snap fastener in a snap fastener aperture and with a rebar-receiving aperture. The next step is snapping the snap fastener into the snap-receiving aperture of the wall. Lastly, the rebar end is threaded through the rebar-receiving aperture of the strap, followed by threading the rebar end into the rebar-receiving channel of the protector member.

Another feature is an apparatus that is easy to use, functional in appearance and suitable for mass production at relatively low cost.

Other novel features which are characteristic of the invention, as to organization and method of operation, together with further objects and advantages thereof will be better understood from the following description considered in connection with the accompanying drawing, in which a preferred embodiment of the invention is illustrated by way of example. It is to be expressly understood, however, that the drawing is for illustration and description only and is not intended as a definition of the limits of the invention.

Certain terminology and derivations thereof may be used in the following description for convenience in reference only, and Will not be limiting. For example, words such as "upwardly," "downwardly," "leftward," and "rightward" would refer to directions in the unless otherwise stated. Similarly, words such as drawings to which reference is made unless otherwise stated. Similarly, words such as "inwardly" and "outwardly" would refer to directions toward and away from, respectively, the geometric center of a device or area and designated parts thereof. References in the singular tense include the plural, and vice versa, unless otherwise noted.

BRIEF DESCRIPTION OF THE DRAWING

FIG. 1 is a perspective view of a preferred end protector of the invention;

FIG. 2 is a perspective view of the strap and snap of the end protector of FIG. 1;

FIG. 3 is a sectional elevation of the end protector of FIG. 1, taken along line 3—3 of FIG. 4;

FIG. 4 is a sectional bottom view of the end protector of FIG. 1, taken along line 4—4 of FIG. 3;

FIG. 5 is a perspective view of a second end protector of the invention;

FIG. 6 is a sectional elevation of the end protector of FIG. 5, taken along line 6—6 of FIG. 7; and FIG. 7 is a sectional bottom view of the end protector of FIG. 5, taken along line 7—7 of FIG. 6.

DRAWING REFERENCE NUMERALS

10 strapped rebar end protector

12 domed protector member

14 elastic strap
16 snap fastener
17 strap and snap member
18 cylindrical wall
19 snap receiving aperture
20 internal rib
22 rebar receiving channel
24 rebar receiving aperture
26 fastener aperture
28 tab
30 disk
32 free end
34 rebar
36 ridge
110 strapped rebar end protector
111 top
112 flat topped protector member
113 metal plate
114 elastic strap
116 snap fastener
117 strap and snap member
118 cylindrical wall
119 snap receiving aperture
120 internal rib
121 external rib
122 rebar receiving channel
124 rebar receiving aperture
126 fastener aperture
128 tab
130 disk
132 free end
134 rebar
136 ridge It is to be noted that, for convenience, the last two positions of the reference numerals of the alternate embodiment of the invention duplicate those of the numerals of the embodiment of FIG. 1, where reference is made to similar or corresponding parts. However, it should not be concluded merely from this numbering convention that similarly numbered parts are equivalents.

DESCRIPTION OF A PREFERRED EMBODIMENT

Referring to FIGS. 1–4, there is illustrated therein a strapped rebar end protector 10, principally comprising a domed protector member 12 of conventional design in combination with the improvement comprising a strap and snap member 17 (FIG. 2). The strap and snap member 17 is comprised of an elastic strap 14 and a snap fastener 16.

The domed protector member 12 has a vertical cylindrical wall 18. Directed inward from the interior circumference of the cylindrical wall 18 are a number of internal ribs 20 which together define a rebar-receiving channel 22. At any suitable position in the cylindrical wall 18, a snap-receiving aperture 19 is formed. The snap-receiving aperture 19 may be molded into the cylindrical wall 18 during manufacture of the end protector 10, or a pre-existing domed protector member 12 may be modified in the field by drilling the snap-receiving aperture 19.

The elastic strap 14 is a band of elastic material, such as rubber or a resilient elastomeric plastic. At each end of the elastic strap 14 is formed an aperture. The open rebar-receiving aperture 24 is large enough to receive rebar of standard size without tearing, but needs to expand significantly to do so. The fastener aperture 26 is considerably smaller—small enough to permanently hold the snap fastener 16 upon its insertion therein. Enough band material protrudes beyond the rebar-receiving aperture 24 to form a finger-gripping tab 28.

The snap fastener 16 preferably is of the type having a plurality of flexible disks 30 (or portions of disks), the disks forming catch means for holding the snap fastener 16 in the snap-receiving aperture 19 of the cylindrical wall 18 after the snap fastener 16 is forcibly pressed therein. Alternatively, fastener means such as screws, bolts and nuts, rivets, and the like may be used to attach the elastic strap 14 to the domed protector member 12.

To use the device to provide protection against accidental worker injury, the free end 32 of a protruding piece of rebar 34 is first threaded through the rebar-receiving aperture 24 of the elastic strap 14. The tab 28 may be used to assist in drawing the elastic strap 14 down the rebar 34. Next, the free rebar end 32 is threaded into the rebar-receiving channel 22 of the domed protector member 12. Finally, the tab 28 is used to stretch the elastic strap 14 down the rebar 34 into a fixed taut state. The rebar-receiving aperture 24 will catch on one of the raised ridges 36 of the rebar 34.

Thereafter, most forces tending to dislodge the end protector 10 will be countered by the elastic strap 14. The stretched state of the elastic strap 14 will tend to reseat the end protector 10 when it is dislodged slightly. This prevents multiple slight dislocations from eventually resulting in the complete separation of the end protector 10 from the rebar 34.

Turning to FIGS. 5–7, there is illustrated therein a second preferred strapped rebar end protector 110, principally comprising a flat-topped protector member 112 of conventional design, in combination with the improvement comprising a strap and snap member 117 having an elastic strap 114 and a snap fastener 116.

The flat topped protector member 112 has a vertical cylindrical wall 118. Directed inward from the interior of the cylindrical wall 118 are a number of internal ribs 120 which together define a rebar-receiving channel 122. At any suitable position in the cylindrical wall 118, a snap-receiving aperture 119 is formed. The snap-receiving aperture 119 may be molded into the cylindrical wall 118 during manufacture of the end protector 110, or a pre-existing flat topped protector member 112 may be modified by drilling the snap-receiving aperture 119 in the field.

The broad flat top 111 of the flat-topped protector member 112 is supported by a number of external ribs 121 which protrude radially outward from the exterior of the cylindrical wall 118. For additional protection against puncture during high impact, a metal plate 113 is affixed to the lower surface of the flat top 111.

The elastic strap 114 is a band of elastic material. At each end of the elastic strap 114 is formed an aperture. The open rebar-receiving aperture 124 is large enough to receive rebar of standard size without tearing. The fastener aperture 126 is considerably smaller. Enough band material protrudes beyond the rebar-receiving aperture 124 to form a finger-gripping tab 128.

The snap fastener 116 preferably is of the type having a plurality of flexible disks 130 (or portions of disks), the disks forming catch means for holding the fastener aperture 126 in the snap-receiving aperture 119 of the cylindrical wall 118 when the snap fastener 116 is forcibly pressed therein.

To use the device to provide protection against accidental worker injury, the free end 132 of a protruding piece of rebar 134 is first threaded through the rebar-receiving aperture 124 of the elastic strap 114. The tab 128 may be used to assist in drawing the elastic strap 114 down the rebar 134. Next, the free end 132 of the rebar 134 is threaded into the rebar-receiving channel 122 of the flat topped protector member 112. Finally, the tab 128 is used to stretch the elastic strap 114 into a permanently taut state. The rebar-receiving aperture 124 will catch on one of the raised ridges 136 of the rebar 134.

Thereafter, most forces tending to dislodge the end protector 110 will be countered by the elastic strap 114. The stretched state of the elastic strap 114 will tend to reseat the end protector 110 when it is dislodged slightly. This prevents multiple slight dislocations from eventually resulting in the complete separation of the end protector 110 from the rebar 134.

While the above provides a full and complete disclosure of the preferred embodiments of this invention, various modifications, alternative constructions, and equivalents may be employed without departing from the true spirit and scope of the invention. Such changes might involve alternative materials, components, structural arrangements, sizes, operational features or the like. For example, a plurality of strap and snap members may be affixed to an end protector, providing additional protection. Therefore, the above description and illustrations should not be construed as limiting the scope of the invention, which is defined by the appended claims.

What is claimed is:

1. In combination with a rebar end protector having a wall, the improvement comprising:

an elastic strap affixed to the wall of the end protector, the strap having a rebar-receiving aperture formed at a first end of the strap;

a snap-receiving aperture formed in the wall; and fastener means for affixing the strap to the end protector, the fastener means having a snap fastener affixed to the strap, the snap fastener engagable within the snap-receiving aperture of the wall.

2. The apparatus of claim 1 further including:

disk catch means on the snap fastener for holding the snap fastener in the snap-receiving aperture.

3. The apparatus of claim 2 further including:

a snap fastener aperture formed at a second end of the strap, the snap fastener engaged within the snap fastener aperture of the strap and within the snap-receiving aperture of the wall.

4. A strapped rebar end protector including:

a protector member having a downwardly depending circumferential wall, the wall forming a snap-receiving aperture, and a rebar-receiving channel formed within the circumference of the wall; and a snap and strap member having an elastic strap forming a rebar-receiving aperture on a first end of the strap and a snap fastener aperture on a second end of the strap, and a snap fastener in the snap fastener aperture and the snap-receiving aperture.

5. The apparatus of claim 4 further including:

disk catch means on the snap fastener for holding the snap fastener in the snap-receiving aperture; and a tab portion on the strap which extends beyond the rebar-receiving aperture toward the first end of the strap, for grasping and pulling the strap.

6. The apparatus of claim 4 wherein:

the protector member has a domed top affixed above the wall.

7. The apparatus of claim 4 wherein:

the protector member has a flat top affixed above the wall and a metal plate affixed beneath the flat top.

8. A method of protecting the exposed end of a rod of rebar including the steps of:

providing a protector member having a downwardly depending circumferential wall, and a rebar-receiving channel formed within the circumference of the wall;

drilling a snap-receiving aperture into the wall;

providing a snap and strap member having an elastic strap forming a snap fastener aperture and a rebar-receiving aperture, and a snap fastener in the snap fastener aperture;

snapping the snap fastener into the snap-receiving aperture of the wall;

threading the rebar end through the rebar-receiving aperture of the strap; and threading the rebar end into the rebar-receiving channel of the protector member.

* * * * *